US010099361B2

(12) United States Patent
Locke

(10) Patent No.: US 10,099,361 B2
(45) Date of Patent: Oct. 16, 2018

(54) COMBINATION GRIPPING AND CUTTING TOOL

(71) Applicant: Bobby Locke, El Centro, CA (US)

(72) Inventor: Bobby Locke, El Centro, CA (US)

( * ) Notice: Subject to any disclaimer, the term of this patent is extended or adjusted under 35 U.S.C. 154(b) by 277 days.

(21) Appl. No.: 14/992,074

(22) Filed: Jan. 11, 2016

(65) Prior Publication Data

US 2017/0197304 A1 Jul. 13, 2017

(51) Int. Cl.

| | |
|---|---|
| ***B25F 1/00*** | (2006.01) |
| ***B26D 3/16*** | (2006.01) |
| ***B67B 7/20*** | (2006.01) |
| ***B67B 7/18*** | (2006.01) |

(52) U.S. Cl.

CPC ..... *B25F 1/003* (2013.01); *B26D 3/169* (2013.01); *B67B 7/18* (2013.01); *B67B 7/20* (2013.01)

(58) Field of Classification Search

CPC ... B25F 1/003; B67B 7/18; B67B 7/20; B67B 7/22; B26D 3/169; B26B 13/00

See application file for complete search history.

(56) References Cited

U.S. PATENT DOCUMENTS

| | | | | |
|---|---|---|---|---|
| 4,658,456 | A | 4/1987 | Tsai | |
| 6,370,780 | B1 * | 4/2002 | Robertson | B26B 13/00 30/261 |
| D581,233 | S | 11/2008 | Sullivan | |
| 7,966,681 | B2 | 6/2011 | Harris | |
| 8,136,188 | B2 | 3/2012 | Bell | |
| D690,176 | S | 9/2013 | Ronan | |
| 2009/0044343 | A1 | 2/2009 | Grave | |
| 2010/0139100 | A1 | 6/2010 | Mortensen | |
| 2014/0157524 | A1 | 6/2014 | Mote | |

* cited by examiner

*Primary Examiner* — David B Thomas

(57) ABSTRACT

A combination gripping and cutting tool for cutting pipe and gripping can lids includes a pair of handles that are rigid. Each handle comprises a grasp that is arcuate. The handles are pivotally coupled, such that the grasps are opposing. A support, which is arcuate, extends transversely from a respective grasp. A channel is positioned in the support. A blade that extends transversely from a respective grasp is complementary to and positioned through the channel. Each of a pair of cutouts is positioned in a respective grasp. The cutouts are arcuate and opposing. Each of a pair of grips is coupled to a respective cutout. The grips are configured to engage a lid of a can when the grasps are pivoted inwardly. The handles are positionable with the support separated from the blade, such that a pipe is positionable between the blade and the support for cutting.

13 Claims, 3 Drawing Sheets

COMBINATION GRIPPING AND CUTTING TOOL

BACKGROUND OF THE DISCLOSURE

Field of the Disclosure

The disclosure relates to cutting tools and more particularly pertains to a new cutting tool for cutting pipe and gripping can lids.

SUMMARY OF THE DISCLOSURE

An embodiment of the disclosure meets the needs presented above by generally comprising a pair of handles that are rigid. Each handle comprises a grasp that is arcuate. The handles are pivotally coupled, such that the grasps are opposing. A support, which is arcuate, extends transversely from a respective grasp. A channel is positioned in the support. A blade that extends transversely from a respective grasp is complementary to and positioned through the channel. Each of a pair of cutouts is positioned in a respective grasp. The cutouts are arcuate and opposing. Each of a pair of grips is coupled to a respective cutout. The grips are configured to engage a lid of a can when the grasps are pivoted inwardly. The handles are positionable with the support separated from the blade, such that a pipe is positionable between the blade and the support for cutting.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
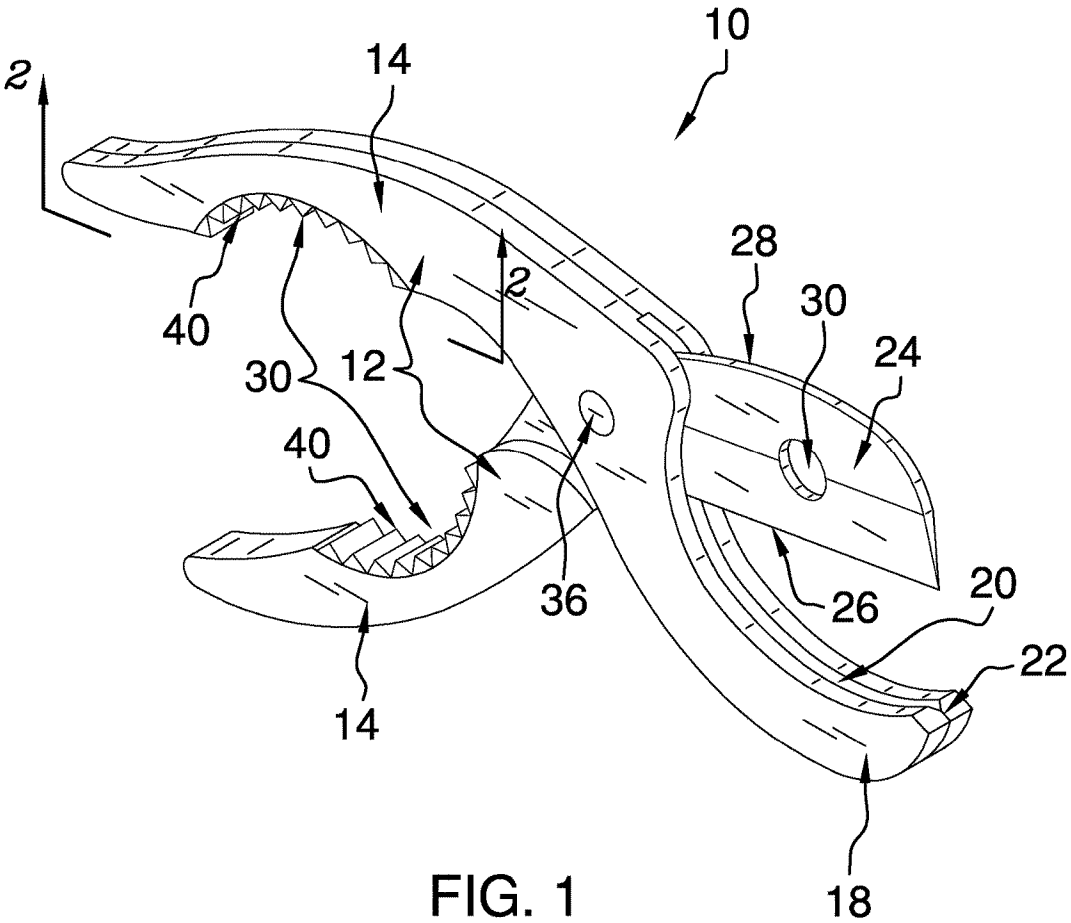
FIG. 1 is an isometric perspective view of a combination gripping and cutting tool according to an embodiment of the disclosure.
Figure 2:
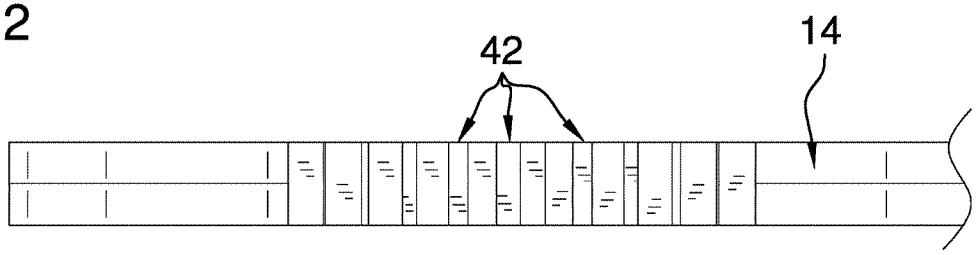
FIG. 2 is a cross-sectional view of an embodiment of the disclosure.
Figure 3:
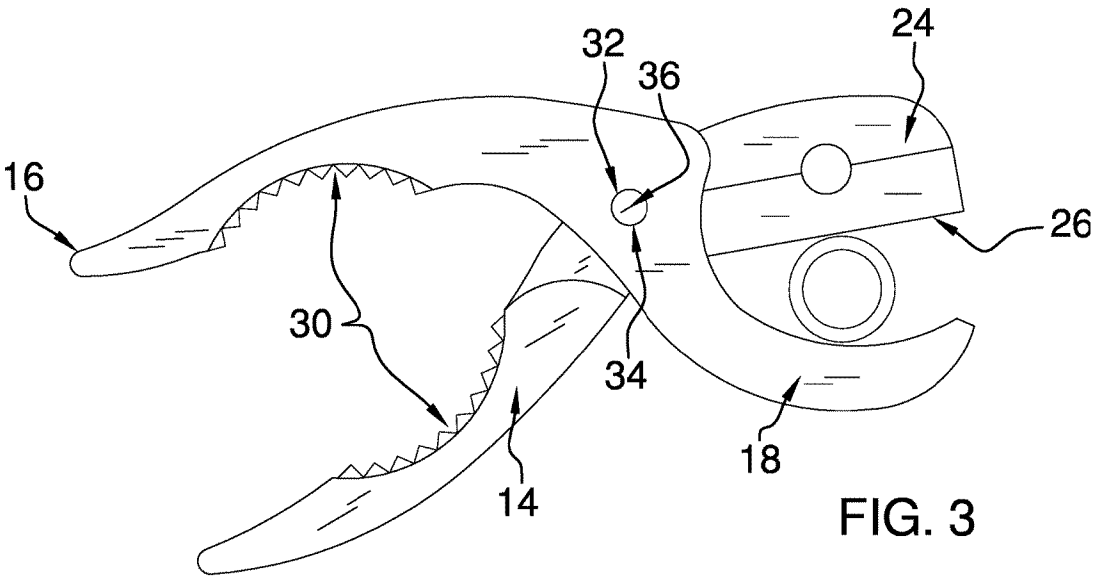
FIG. 3 is a side in-use view of an embodiment of the disclosure.
Figure 4:
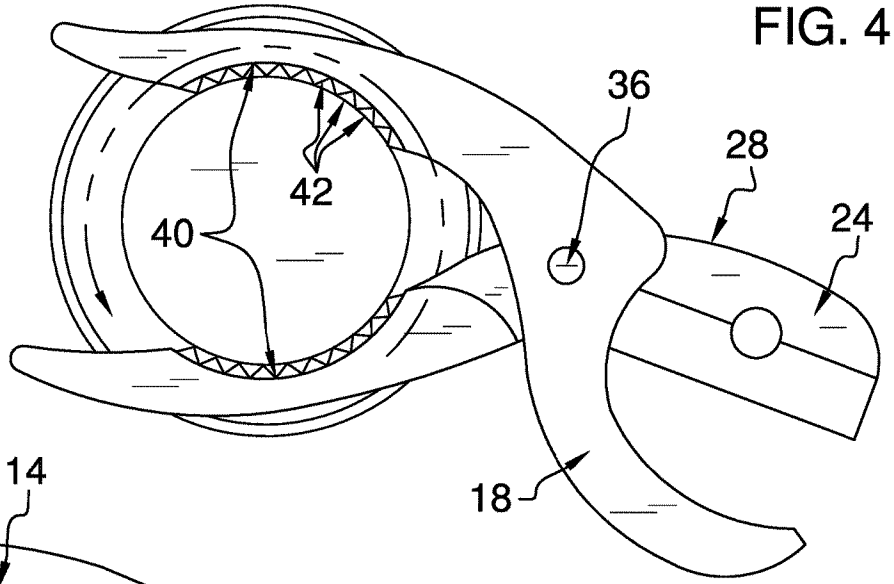
FIG. 4 is a side in-use view of an embodiment of the disclosure.
Figure 5:
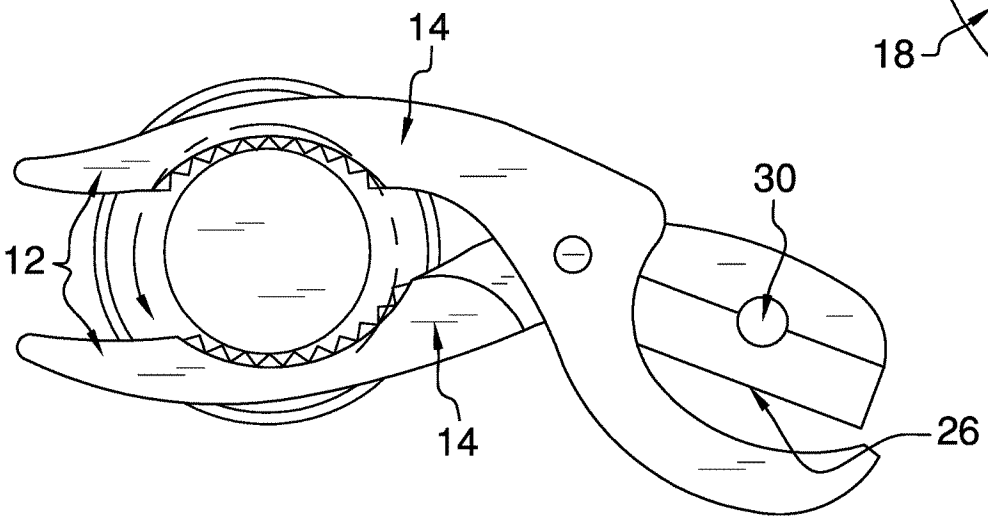
FIG. 5 is a side in-use view of an embodiment of the disclosure.

With reference now to the drawings, and in particular to FIGS. 1 through 5 thereof, a new cutting tool embodying the principles and concepts of an embodiment of the disclosure and generally designated by the reference numeral 10 will be described.

As best illustrated in FIGS. 1 through 5, the combination gripping and cutting tool 10 generally comprises a pair of handles 12 that are rigid. Each handle 12 comprises a grasp 14 that is arcuate. The handles 12 are pivotally coupled, such that the grasps 14 are opposing. A respective handle 12 has a first end 16 that is flared, such that the first end 16 is configured to deter slippage of a user's palm from a respective grasp 14.

A support 18 extends transversely from a respective grasp 14. The support 18 is arcuate. A channel 20 is positioned in the support 18 and extends from adjacent to a respective grasp 14 to proximate to a terminus 22 of the support 18. A blade 24 extends transversely from a respective grasp 14. The blade 24 is complementary to the channel 20 and is positioned through the channel 20. The blade 24 and the support 18 are pivotally coupled proximate to the grasps 14, such that the blade 24 extends through the channel 20. A pipe placed longitudinally between the blade 24 and the support 18 is severed when the grasps 14 are pivoted inwardly. The blade 24 comprises a cutting edge 26 and a top edge 28, which is curved. The blade 24 is configured for cutting plastic pipe. More preferably, the blade 24 is configured for cutting polyvinyl chloride pipe. A penetration 30, which is circular, is substantially centrally positioned in the blade 24.

More specifically, a first pivot hole 32 is positioned through the channel 20 proximate to the respective grasp 14. A second pivot hole 34 is positioned through the blade 24 proximate to the respective grasp 14. The second pivot hole 34 is complementary to the first pivot hole 32. A pivot pin 36 is positioned through the first pivot hole 32 and the second pivot hole 34, such that the pair of handles 12 is pivotally coupled.

Each of a pair of cutouts 38 is positioned in a respective grasp 14. The cutouts 38 are arcuate and opposingly positioned. Each of a pair of grips 40 is coupled to a respective cutout 38. The grips 40 are positioned in the cutouts 38 such that the grips 40 are configured to engage a lid of a can when the grasps 14 are pivoted inwardly. The grips 40 comprise serrations 42. Preferably, the serrations 42 are triangular and complementary to the annular ridges around a lid of a can.

In use, the handles 12 are positionable with the support 18 separated from the blade 24. A pipe is positionable longitudinally between the blade 24 and the support 18. The grasps 14 are configured for grasping in a hand of the user and such that the grasps 14 are positioned to pivot inwardly. The blade 24 is compelled into the channel 20 to sever the pipe. The device 10 also can be utilized for opening a can. The grips 40 are positioned in the cutouts 38 to engage the lid of the can when the grasps 14 are pivoted inwardly.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A combination gripping and cutting tool comprising:

a pair of handles, said handles being rigid, each said handle comprising a grasp, said grasps being arcuate, said handles being pivotally coupled, such that said grasps are opposing;

a support, said support extending transversely from a respective said grasp, said support being arcuate;

a channel, said channel being positioned in said support;

a blade, said blade extending transversely from a respective said grasp, said blade being complementary to said channel, said blade being positioned through said channel, a penetration, said penetration being circular, said penetration being substantially centrally positioned in said blade wherein said penetration is configured to facilitate alignment of a pipe with a middle of said blade to prevent slippage of said pipe along said blade when said pipe is squeezed between said blade and said support;

a pair of cutouts, said cutouts being arcuate, each said cutout being positioned in a respective said grasp, said pair of cutouts being opposing;

a pair of grips, each said grip being coupled to a respective said cutout, wherein said grips are positioned in said cutouts such that said grips are configured to engage a lid of a can when said grasps are pivoted inwardly; and wherein said handles are positionable with said support separated from said blade, wherein the pipe is positionable longitudinally between said blade and said support, wherein said grasps are configured for grasping in a hand of the user and wherein said grasps are positioned to pivot inwardly such that said blade is compelled into said channel to sever the pipe, and wherein said grips are positioned in said cutouts such that said grips are configured to engage the lid of the can when said grasps are pivoted inwardly.

2. The tool of claim 1, further including a respective said handle having a first end, said first end being flared, wherein said first end is configured to deter slippage of a user's palm from a respective said grasp.

3. The tool of claim 1, further including said channel extending from adjacent to said respective said grasp to proximate to a terminus of said support.

4. The tool of claim 1, further including said blade and said support being pivotally coupled proximate to said grasps, wherein said blade extends through said channel such that a pipe placed longitudinally between said blade and said support is severed when said grasps are pivoted inwardly.

5. The tool of claim 1, further including said blade comprising a cutting edge and a top edge.

6. The tool of claim 5, further including said top edge being curved.

7. The tool of claim 1, further including said blade being configured for cutting plastic pipe.

8. The tool of claim 7, further including said blade being configured for cutting polyvinyl chloride pipe.

9. The tool of claim 1, further comprising:

a first pivot hole, said first pivot hole being positioned through said channel proximate to said respective said grasp;

a second pivot hole, said second pivot hole being positioned through said blade proximate to said respective said grasp, said second pivot hole being complementary to said first pivot hole;

a pivot pin, said pivot pin being positioned through said first pivot hole and said second pivot hole; and wherein said pair of handles are pivotally coupled.

10. The tool of claim 1, further including said grips comprising serrations.

11. The tool of claim 10, further including said serrations being triangular.

12. The tool of claim 10, further including said serrations being complementary to the annular ridges around a lid of a can.

13. A combination gripping and cutting tool comprising:

a pair of handles, said handles being rigid, each said handle comprising a grasp, said grasps being arcuate, said handles being pivotally coupled, such that said grasps are opposing;

a support, said support extending transversely from a respective said grasp, said support being arcuate;

a respective said handle having a first end, said first end being flared, wherein said first end is configured to deter slippage of a user's palm from a respective said grasp;

a channel, said channel being positioned in said support, said channel extending from adjacent to said respective said grasp to proximate to a terminus of said support;

a blade, said blade extending transversely from a respective said grasp, said blade being complementary to said channel, said blade being positioned through said channel, said blade and said support being pivotally coupled proximate to said grasps, wherein said blade extends through said channel such that a pipe placed longitudinally between said blade and said support is severed when said grasps are pivoted inwardly, said blade comprising a cutting edge and a top edge, said top edge being curved, said blade being configured for cutting plastic pipe, said blade being configured for cutting polyvinyl chloride pipe;

a penetration, said penetration being circular, said penetration being substantially centrally positioned in said blade wherein said penetration is configured to facilitate alignment of the pipe with a middle of said blade to prevent slippage of the pipe along said blade when said pipe is squeezed between said blade and said support;

a first pivot hole, said first pivot hole being positioned through said channel proximate to said respective said grasp;

a second pivot hole, said second pivot hole being positioned through said blade proximate to said respective said grasp, said second pivot hole being complementary to said first pivot hole;

a pivot pin, said pivot pin being positioned through said first pivot hole and said second pivot hole, wherein said pair of handles are pivotally coupled;

a pair of cutouts, said cutouts being arcuate, each said cutout being positioned in a respective said grasp, said pair of cutouts being opposing;

a pair of grips, each said grip being coupled to a respective said cutout, wherein said grips are positioned in said cutouts such that said grips are configured to engage a lid of a can when said grasps are pivoted inwardly, said grips comprising serrations, said serrations being triangular, said serrations being complementary to the annular ridges around a lid of a can; and wherein said handles are positionable with said support separated from said blade, wherein a pipe is positionable longitudinally between said blade and said support, wherein said grasps are configured for grasping in a hand of the user and wherein said grasps are positioned to pivot inwardly such that said blade is compelled into said channel to sever the pipe, and wherein said grips are positioned in said cutouts such that said grips are configured to engage the lid of the can when said grasps are pivoted inwardly.

* * * * *